US011033134B2

(12) United States Patent
Mithal et al.

(10) Patent No.: US 11,033,134 B2
(45) Date of Patent: Jun. 15, 2021

(54) STACKED CUTLERY SYSTEM AND METHOD

(71) Applicant: Waddington North America, Inc., Chelmsford, MA (US)

(72) Inventors: Ashish K Mithal, Chelmsford, MA (US); William A Gallop, Westminster, MA (US)

(73) Assignee: Waddington North America, Inc., Chelmsford, MA (US)

( * ) Notice: Subject to any disclaimer, the term of this patent is extended or adjusted under 35 U.S.C. 154(b) by 101 days.

(21) Appl. No.: 16/091,835

(22) PCT Filed: Apr. 5, 2017

(86) PCT No.: PCT/US2017/026202

§ 371 (c)(1),
(2) Date: Oct. 5, 2018

(87) PCT Pub. No.: WO2017/176918

PCT Pub. Date: Oct. 12, 2017

(65) Prior Publication Data

US 2019/0125112 A1 May 2, 2019

Related U.S. Application Data

(60) Provisional application No. 62/318,400, filed on Apr. 5, 2016.

(51) Int. Cl.
*B65D 71/00* (2006.01)
*A47G 21/06* (2006.01)
(Continued)

(52) U.S. Cl.
CPC ..... *A47G 21/02* (2013.01); *A47F 1/06* (2013.01); *A47F 2001/103* (2013.01);
(Continued)

(58) Field of Classification Search
CPC ..... A47G 21/02; A47G 21/023; A47G 21/04; A47F 1/06; A47F 2001/103; B26B 3/02
(Continued)

(56) References Cited

U.S. PATENT DOCUMENTS 512,162 A 1/1894 Cuddy
2,141,684 A 12/1938 Diemer
(Continued)

FOREIGN PATENT DOCUMENTS

CN 101066183 A 11/2007
JP 2002211633 A 7/2002
(Continued)

OTHER PUBLICATIONS

Office Action dated Jan. 8, 2019 for U.S. Appl. No. 13/161,767, 8 pages.
(Continued)

*Primary Examiner* — Luan K Bui
(74) *Attorney, Agent, or Firm* — Maine Cernota & Rardin

(57) ABSTRACT

A system for easily refilling cutlery dispensers or other devices includes a stack of identical cutlery items maintained by a retaining structure that can be removable either before, during, or after installation, depending on the configuration of the dispenser. In a first aspect, the retaining structure includes nested cutlery handles and a single adhesive strip applied to one side of the stack. In a second aspect, the retaining structure includes separate adhesive strips applied to each side of the stack. In a third aspect, the retaining structure is a band extending entirely around the stack and equipped with a pull-tab for opening and removing the retaining structure. In all aspects a pull-tab or other graspable element can be provided to facilitate removal of the support structure. The stacked cutlery may also be loaded into a caddy or into a tray.

8 Claims, 11 Drawing Sheets

(51) Int. Cl.

| | |
|---|---|
| ***A47G 21/02*** | (2006.01) |
| ***A47F 1/06*** | (2006.01) |
| *A47F 1/10* | (2006.01) |
| *A47G 21/04* | (2006.01) |
| *B26B 3/02* | (2006.01) |

(52) U.S. Cl.
CPC ..... *A47G 21/023* (2013.01); *A47G 21/04* (2013.01); *B26B 3/02* (2013.01)

(58) Field of Classification Search
USPC ..... 206/460, 505, 553; 211/70.7; 248/37.3; 30/123, 136, 137, 142, 147–150
See application file for complete search history.

(56) References Cited

U.S. PATENT DOCUMENTS

| | | | | |
|---|---|---|---|---|
| 2,149,099 | A | 2/1939 | Phinney et al. | |
| 2,216,005 | A | 9/1940 | Goldstein | |
| 2,752,678 | A | 7/1956 | Welch | |
| 2,911,127 | A | 11/1959 | Driss et al. | |
| 3,635,350 | A | 1/1972 | Wolf | |
| 3,987,901 | A * | 10/1976 | Dullinger | B65C 9/10 206/451 |
| 4,134,519 | A | 1/1979 | Barnett et al. | |
| 4,426,056 | A | 1/1984 | Gelardi et al. | |
| D275,167 | S | 8/1984 | Laslo | |
| 4,524,512 | A * | 6/1985 | Formo | A47G 21/06 30/147 |
| 4,539,749 | A | 9/1985 | Hyeing-Woon | |
| 4,610,087 | A | 9/1986 | Mickelson et al. | |
| 4,995,154 | A | 2/1991 | Bamber | |
| 5,131,562 | A | 7/1992 | Brown | |
| 5,295,592 | A | 3/1994 | Thorne | |
| 5,855,285 | A | 1/1999 | Laird et al. | |
| 5,855,422 | A | 1/1999 | Naef | |
| 5,904,250 | A * | 5/1999 | De Schutter | B65D 71/00 206/553 |
| 5,921,408 | A | 7/1999 | Gronewold et al. | |
| 6,251,498 | B1 | 6/2001 | Lovejoy | |
| 6,336,568 | B1 | 1/2002 | Tucker et al. | |
| 6,662,967 | B2 | 12/2003 | Roy | |
| 6,832,694 | B2 | 12/2004 | Goeking et al. | |
| 7,013,568 | B2 | 3/2006 | Schmidt | |
| D584,084 | S | 1/2009 | Tucker et al. | |
| 7,669,732 | B2 | 3/2010 | Njaastad | |
| 7,900,797 | B1 | 3/2011 | Witcraft | |
| 8,272,533 | B1 | 9/2012 | D'Amelia et al. | |
| 8,296,957 | B2 | 10/2012 | Muehlemann | |
| 8,297,473 | B2 | 10/2012 | Smith | |
| 8,839,522 | B2 * | 9/2014 | Walters | A47G 21/06 30/142 |
| 9,049,948 | B2 | 6/2015 | Jongen et al. | |
| 9,226,598 | B1 | 1/2016 | Knope et al. | |
| 9,924,816 | B2 * | 3/2018 | Oakes | A47G 21/06 |
| 10,051,976 | B2 | 8/2018 | Smith | |
| 10,188,226 | B2 | 1/2019 | Babcock et al. | |
| 10,390,631 | B2 * | 8/2019 | Smith | A47F 1/10 |
| 10,779,661 | B2 | 9/2020 | Schoening et al. | |
| 10,881,221 | B2 | 1/2021 | Kennedy et al. | |
| 2002/0112445 | A1 | 8/2002 | Scaduto | |
| 2005/0155229 | A1 * | 7/2005 | Lee | A47G 21/06 30/322 |
| 2007/0000136 | A1 | 1/2007 | Allen et al. | |
| 2007/0108141 | A1 | 5/2007 | Smith et al. | |
| 2008/0128445 | A1 | 6/2008 | Huang et al. | |
| 2010/0170915 | A1 | 7/2010 | Reinsel et al. | |
| 2011/0138632 | A1 | 6/2011 | Wong | |
| 2011/0219631 | A1 | 9/2011 | Hou | |
| 2011/0226797 | A1 | 9/2011 | Reinsel et al. | |
| 2011/0296693 | A1 * | 12/2011 | Oakes | A47G 21/06 30/142 |
| 2013/0193157 | A1 | 8/2013 | Jongen et al. | |
| 2015/0041484 | A1 | 2/2015 | Oakes | |
| 2015/0048108 | A1 * | 2/2015 | Borke | A47F 1/10 221/195 |
| 2015/0257561 | A1 * | 9/2015 | Miksovsky | A47G 21/023 30/150 |
| 2015/0289679 | A1 | 10/2015 | Oakes | |
| 2019/0075940 | A1 | 3/2019 | Pierson | |
| 2019/0223621 | A1 | 7/2019 | Loucks | |

FOREIGN PATENT DOCUMENTS

| | | | |
|---|---|---|---|
| WO | 0105281 | A1 | 1/2001 |
| WO | 2001005281 | A1 | 1/2001 |

OTHER PUBLICATIONS

Office Action dated Jun. 28, 2019 for U.S. Appl. No. 13/161,767, 8 pages.
Office Action dated Mar. 23, 2020 for U.S. Appl. No. 16/182,185, 24 pages.
International Search Report and Written Opinion for PCT Appl. No. PCT/US2020/025001, dated Jul. 14, 2020, 12 Pages.
PCT International Search Report and Written Opinion for Appl No. PCT/US2017/026202 dated Jul. 11, 2017, 14 pages.
Office Action dated May 18, 2020 for European Appl. No. 17779770.1, 3 pages.
English Translation of Office Action for Chinese Patent Appl. No. 201780027881.8, dated Jul. 14, 2020, 15 Pages.
Notice of Allowance for U.S. Appl. No. 16/182,185, dated Sep. 4, 2020, 18 Pages.
Office Action for U.S. Appl. No. 13/161,767, dated Sep. 23, 2020, 39 Pages.
Office Action for European Patent Appl. No. 17779770.1, dated Nov. 3, 2020, 3 Pages.
Office Action for U.S. Appl. No. 16/831,510, dated Mar. 23, 2021, 67 Pages.

* cited by examiner

STACKED CUTLERY SYSTEM AND METHOD

RELATED APPLICATIONS

This application is a national phase application filed under 35 USC § 371 of PCT Application No. PCT/US2017/026202 with an international filing date of Apr. 5, 2017 which claims the benefit of U.S. Provisional application 62/318,400, filed on Apr. 5, 2016. Each of these applications is herein incorporated by reference in its entirety for all purposes.

FIELD OF THE INVENTION

The invention relates to disposable cutlery, and more particularly, to systems and methods for organizing and presenting cutlery during a food service event or at a restaurant for convenient retrieval by one or more users.

BACKGROUND OF THE INVENTION

When food is served to a group of individuals, it is often convenient to present the food in a "buffet" style, whereby the individuals serve themselves from food trays and serving containers according to their individual preferences and appetites. Typically, when food is served in this manner, the required cutlery is also presented in bulk, either directly on the buffet table or contained in appropriate containers, dispensers, or caddies, from which each of the consumers can select the cutlery items they need according to their preferences and/or individual food choices. Similarly, when consumers order food at a quick-service restaurant, the cutlery items and other condiments are generally set-up for self-service and retrieved by a consumer from a bin or dispenser.

One of the advantages of serving food in a buffet or self-serve setting is the reduced workload imposed on the restaurant or catering staff. For small events, it is only necessary to initially present the food, plates and cutlery, after which the consumers serve themselves. However, for larger events, the host or staff may be required to replenish the food, plates, and cutlery periodically as it is removed from the buffet. This requirement can significantly increase the workload and staffing requirement for a food service event. While items such as bowls and plates tend to nest and stack very well and are typically self-stacking, cutlery in particular can be problematic to maintain and replenish, because of the requirement to organize and attractively present a large number of small cutlery items of different types. For example, if the cutlery is laid out in an orderly fashion, rolled in napkins on a tray or laid out separately on a buffet table, this may be space-consuming, and may require undue time and attention from the staff and frequent replenishment of the cutlery.

If a food service setting is very informal (such as a school cafeteria), cutlery is sometimes presented vertically in canisters. This approach has the advantage of using space somewhat efficiently, and of being easy to replenish, because a server need only grasp a "bunch" of cutlery of a desired type and drop the bunch into a canister. However, serving cutlery in canisters can be perceived as somewhat inelegant, and may also raise concerns regarding hygiene, because it can be difficult for a consumer to grasp and remove a single item of cutlery from a canister without touching other cutlery items that remain afterward for others to select and use.

One approach for presenting cutlery in a manner that is compact and hygienic is to provide vertically oriented cutlery dispensers, which can present cutlery to users in a neat and orderly fashion, while allowing each user to dispense and touch only the cutlery items that he or she selects.

Regardless of the type of dispensing device or mechanism employed for dispensing cutlery, cutlery dispensers need to be refilled periodically when the cutlery batch loaded in the dispenser is used up or depleted. If a restaurant or caterer at a food service event is serving a large number of patrons, loading cutlery into the dispenser can be a tedious and time-consuming task for the serving staff, because the cutlery must be neatly ordered and stacked for insertion into the dispenser, and yet the individual cutlery items must be fully unwrapped and detached from each other within the dispenser so that they can be individually dispensed.

What is needed, therefore, is a system and method for organizing cutlery that facilitates refilling of cutlery dispensers with disposable cutlery in a timely and efficient manner. These and other needs, as shall hereinafter appear, are met by the system and method of the present invention.

SUMMARY OF THE INVENTION

A novel system and method are disclosed for easily and efficiently refilling vertically-stacked cutlery dispensers with cutlery. According to the present invention, a plurality of identical cutlery items is maintained in an ordered stack by a retaining structure or element that is released and removed from the cutlery stack either while or immediately after it is inserted into a dispenser. In embodiments, a variety of different retaining structures are described for maintaining a plurality of cutlery items in a stacked bundle for facilitating—ease of handling, shipping, loading into a cutlery dispenser, or transferring into another container.

In some embodiments, the retaining structure is released when the stack is positioned immediately above the dispenser, allowing the cutlery to load into the dispenser by descending under the influence of gravity. In other embodiments the stack of cutlery items along with the retaining structure is inserted into the dispenser, and access is provided in the dispenser for releasing and removing the retaining structure of the inserted stack. In some of these embodiments the retaining structure is released after the stack is fully inserted into the dispenser, while in other embodiments the retaining structure is released while the stack is in an upper portion of the dispenser, after which the stack is allowed to descend into a lower portion of the dispenser.

In a first general aspect of the invention, the retaining structure includes a configuration of the cutlery whereby the retaining structure comprises an adhesive strip applied to only one side of the cutlery stack. In embodiments, at least some portion of each like cutlery item inter-nests into another like cutlery item. For instance, an inter-nesting configuration of cutlery handles includes a raised portion or element on the top surface of the cutlery handle and a corresponding hollow or indentation in the bottom portion, or vice versa, so that when the cutlery items are stacked the raised portion or element of each handle nests within the hollow portion or indentation of an adjacent handle in the cutlery stack. The inter-nesting of cutlery items serves to minimize the horizontal movement, slippage, twisting, and/or skewing of cutlery pieces relative to each other when held in a stacked configuration. Accordingly, a relatively narrow single adhesive strip applied to one side of the cutlery stack maintains the cutlery items in close vertical association with each other, while the horizontal integrity of the stack is maintained during bending and flexing, at least partly, due to the nesting of the stacked cutlery handles.

These features of the invention provide significant advantages over prior art. Current commercial packets for loading cutlery into dispensers require supporting the cutlery stack on both sides in a banded configuration by utilizing an adhesive strip on one side of the stack and a paperboard backer or support material on the other side of the stack. In contrast, according to the present invention a single adhesive strip applied to only one side of the cutlery stack is sufficient to achieve a stable cutlery bundle that is suitable for transporting, handling and loading into the dispenser. The single adhesive strip is constructed from an adhesive formulation that does not leave a residue on the cutlery when removed or separated from the cutlery stack.

In various configurations and embodiments of this aspect of the present invention, the raised portions and the complementary hollow or indented portions of the cutlery handles can extend for substantially the length of the handle, providing increased nesting stability. It will be realized, however, that shorter lengths and other variations of each of these features can be utilized, and in some embodiments each item of cutlery has a plurality of raised portions and a plurality of corresponding hollow or indented portions. According to a typical embodiment, a raised portion of a first cutlery item and a complementary hollow portion of a second cutlery item may be nested tightly, wherein at least a surface of the raised portion of a first cutlery item may be placed in a proximate or contiguous contact with at least a surface of the hollow of a second cutlery item.

In a second general aspect of the invention, the retaining structure includes two adhesive strips, one applied to each side of the stack. This general aspect places no special requirements on the handles of the cutlery in terms of nesting functionality or inter-nesting features.

In a third general aspect of the invention, the retaining structure is in the form of band that extends around a region of the cutlery stack. The band can be flexible, semi-rigid or rigid. In embodiments, the hand is made from plastic, paper, paperboard, chipboard, cardboard, bagasse or any other suitable material. The band configuration according to this aspect of the invention provides an improvement over prior art in that it does not require cutlery articles to be substantially exposed to an adhesive layer and thus naturally avoids the need for utilizing a specialized tape formulation. In some embodiments, the band is initially configured in the form of a strap that is wrapped around a cutlery stack and the two free ends of the strap are joined together to create a bundled stack. The free ends of the strap may be joined by suitable joining means in one of—an overlapping configuration, an abutting configuration and a spaced-apart configuration, depending on the rigidity of the strap material and the assembly method employed such as tape or adhesive strip, hot melt glue, Velcro etc. In some embodiments, the band is configured such that either the top or the bottom thereof is openable and can be easily opened as the stack is inserted into the dispenser or, if access is available, after the stack has been inserted into the dispenser. In some embodiments of this general aspect, the openable end of the band (which can be located at the top, the bottom, or the side of the cutlery stack) is formed by a strip that is adhesively attached to the two sides of the band. In still other embodiments, the bottom/openable end of the band includes a frangible perforation that allows the bottom/openable end to be easily opened. once the banded cutlery stack has been properly transferred into the dispenser, and thereafter removed from the dispenser. In various embodiments, a tab or other graspable element is provided at the bottom of the hand which can be used to remove the bottom section, tear a perforation, or otherwise disrupt the continuity of the band so that the stack of cutlery items can be properly transferred into the dispenser and the band can be lifted upward and removed.

In other embodiments of this general aspect of the invention, the top of the band includes a short adhesive strip attached to the sides of the band, along with a pull tab for facilitating removal of the adhesive strip and the band once the cutlery stack has been inserted into a dispenser device, in some embodiments, the adhesive strip further comprises a frangible perforation that facilitates easy removal of the adhesive strip from the hand during or after loading of the banded cutlery into the dispenser.

According to still other embodiments, the retaining structure is in the form of a closed band or sleeve into which a cutlery stack is slid into. The closed band or sleeve can be constructed from a relative rigid paperboard for maintaining the cutlery stack in a self-supporting configuration with a frangible portion for removing the band from the cutlery stack once it has been installed in the dispenser. In another embodiment, the closed band or sleeve is in the form of a flexible plastic or polymeric shrink band which is adapted to loosely encircle the cutlery stack, prior to shrinking, which upon application of heat is shrink-wrapped around the cutlery stack relatively tightly for creating a unified bundle that can be handled, shipped, and inserted into a dispenser with ease. The shrink-wrapped hand may include a tab and a frangible portion that can be used to separate the band from the cutlery stack once the cutlery stack has been transferred into the dispenser.

The retaining structure(s) for cutlery stacks and bundling of cutlery items, according to various embodiments of the invention, not only facilitate loading cutlery into a dispenser but also convey additional advantages in the form of reduced shipping and storage costs due to a more compact product configuration and hence a better carbon footprint. A compact product configuration yields benefits throughout the supply chain at—the manufacturer, the distributor and the restaurant operator. According to an embodiment of the invention, cutlery items in multiples of 10 (10, 20, 30, 40, or 50) are stacked together and then consolidated or bundled by utilizing a retaining structure for allowing both convenience of handling and loading into the dispenser as well as accounting of the cutlery items needed or on hand.

It should be noted that the present invention, including all of its general aspects, is not limited to use with cutlery dispensers, but may also be used as a convenient system for providing cutlery in an efficient and organized manner, for example for providing cutlery for placement in a simple caddy or for separate, ordered placement of cutlery on a buffet table, a tray, or in a container.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1:
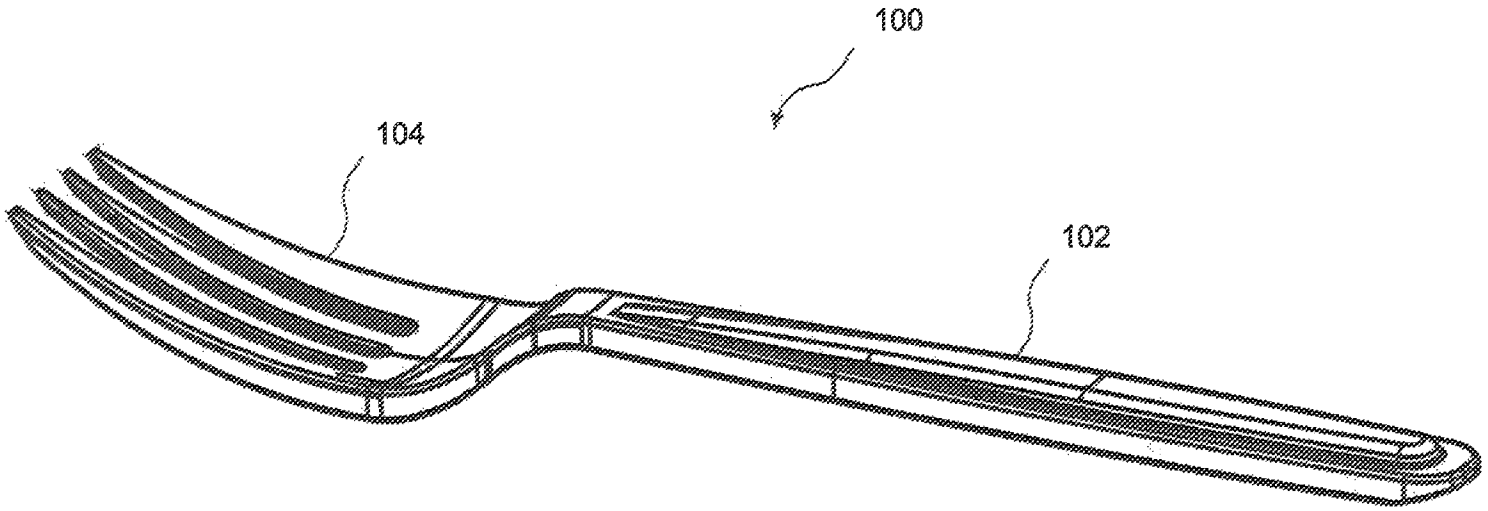
FIG. 1 is a perspective view of a single item of cutlery having a nestable handle according to a first general aspect of the invention.

The present invention is a novel system and method for organizing and retaining a plurality of cutlery items in a stacked configuration that can be easily and efficiently shipped, handled, and loaded into a cutlery dispenser or a presentation device for easy retrieval and use. With reference to FIG. 1, each cutlery item 100 in a stack includes a handle 102 and a food-contacting head 104. A plurality of identical cutlery items 100, which can be permanent ware or disposable cutlery items, is maintained in an ordered stack by a retaining structure that is removed from the stack either during insertion or after the cutlery stack is inserted into a dispenser.

In some embodiments, the retaining structure is released when the stack is immediately above the dispenser, thereby allowing the cutlery to load into the dispenser by descending under the influence of gravity. In other embodiments, the stack of cutlery items is inserted into the dispenser, and an access area is provided within the dispenser for grasping and removing the retaining structure of the inserted stack. In some of these embodiments the retaining structure is released after the stack is fully inserted into the dispenser, while in other embodiments the retaining structure is released while the stack is in an upper portion of the dispenser, after which the stack is allowed to descend into a lower portion of the dispenser.

Figure 2B:
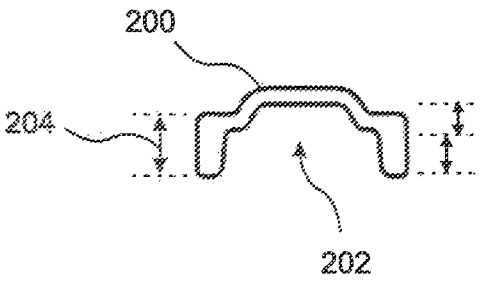
FIG. 2B is a cross sectional illustration of the handle of the cutlery item of FIG. 1.
Figure 2A:
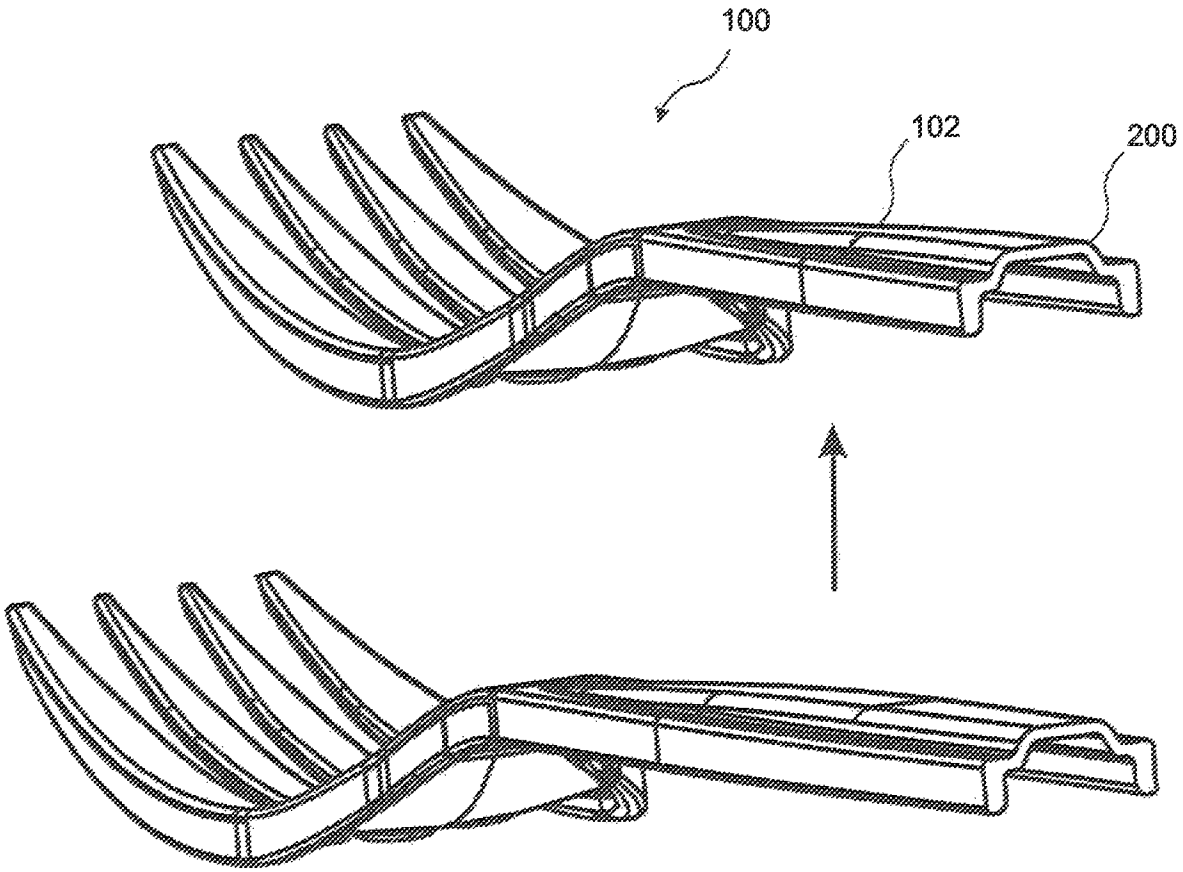
FIG. 2A is a perspective sectional view of a pair of cutlery items as shown in FIG. 1, arranged one above the other.

With reference to FIGS. 2A and 2B, in a first general aspect of the invention the retaining structure comprises an adhesive strip applied on only one side of the stack of cutlery items 100. In embodiments, each cutlery handle 102 includes a raised portion 200 on the top surface thereof and a corresponding hollow 202 in the bottom portion, or vice versa, so that when the cutlery items 100 are stacked the raised portion 200 of each handle 102 nests within the hollow portion 202 of an adjacent handle 102 in the stack. The degree of inter-nesting between two cutlery items in a stack can be varied according to the degree of movement desired between two cutlery pieces. According to an embodiment of the invention the inter-nested handles are only allowed relative movement in the transverse direction (relative to the longitudinal axes of the handles) of less than 0.1 inches, or about 2.5 mm. In other embodiments, the allowed relative transverse movement is less than 0.063 inches, or about 1.6 mm. In embodiments, the raised portion 202 of each handle nests within the hollow 202 of the adjacent handle to a depth that is at least 20% of the vertical thickness of the handles.

Figure 3:
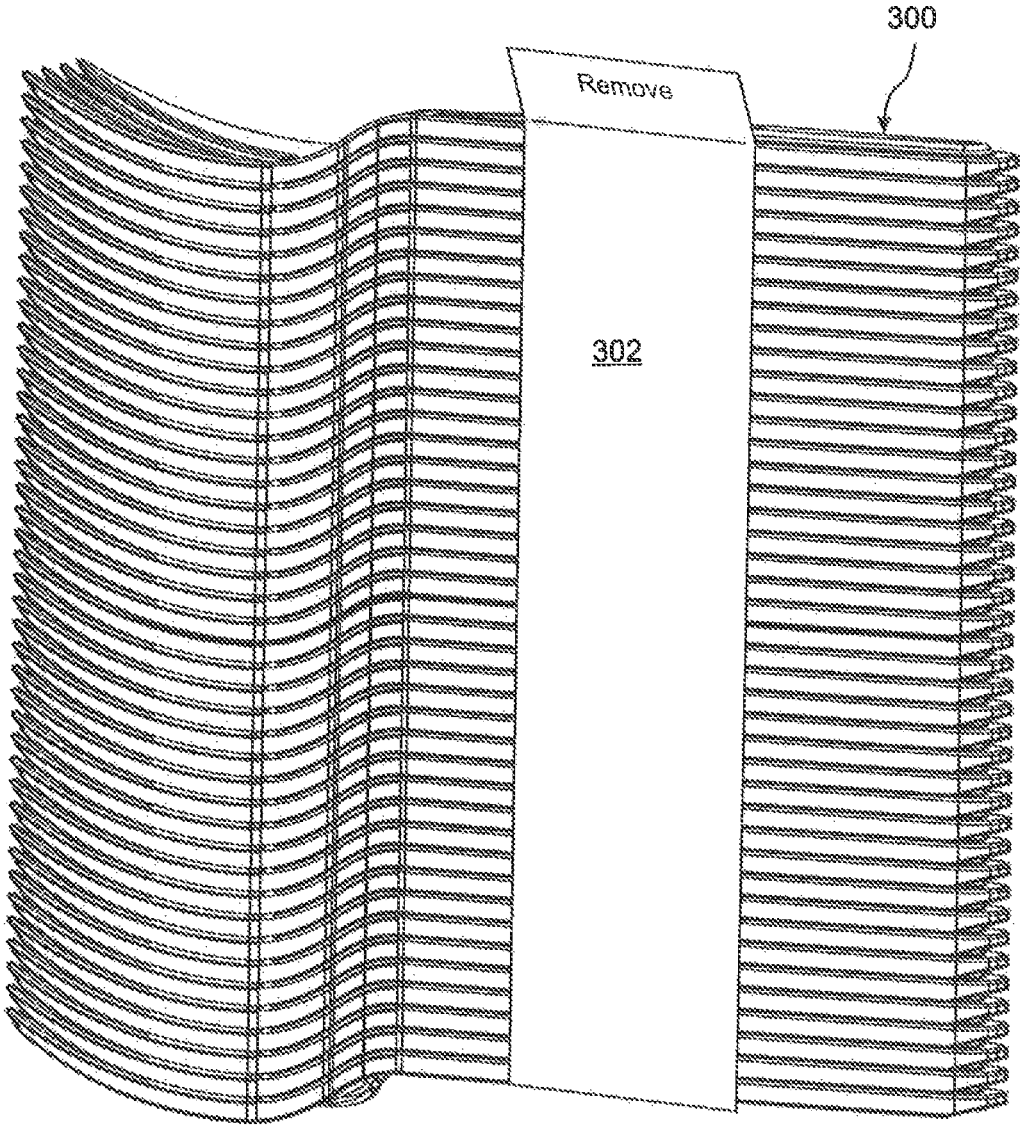
FIG. 3 is a perspective side view of a stack of cutlery items of the type shown in FIG. 1, wherein an adhesive strip is applied to one side of the stack.
Figure 4:
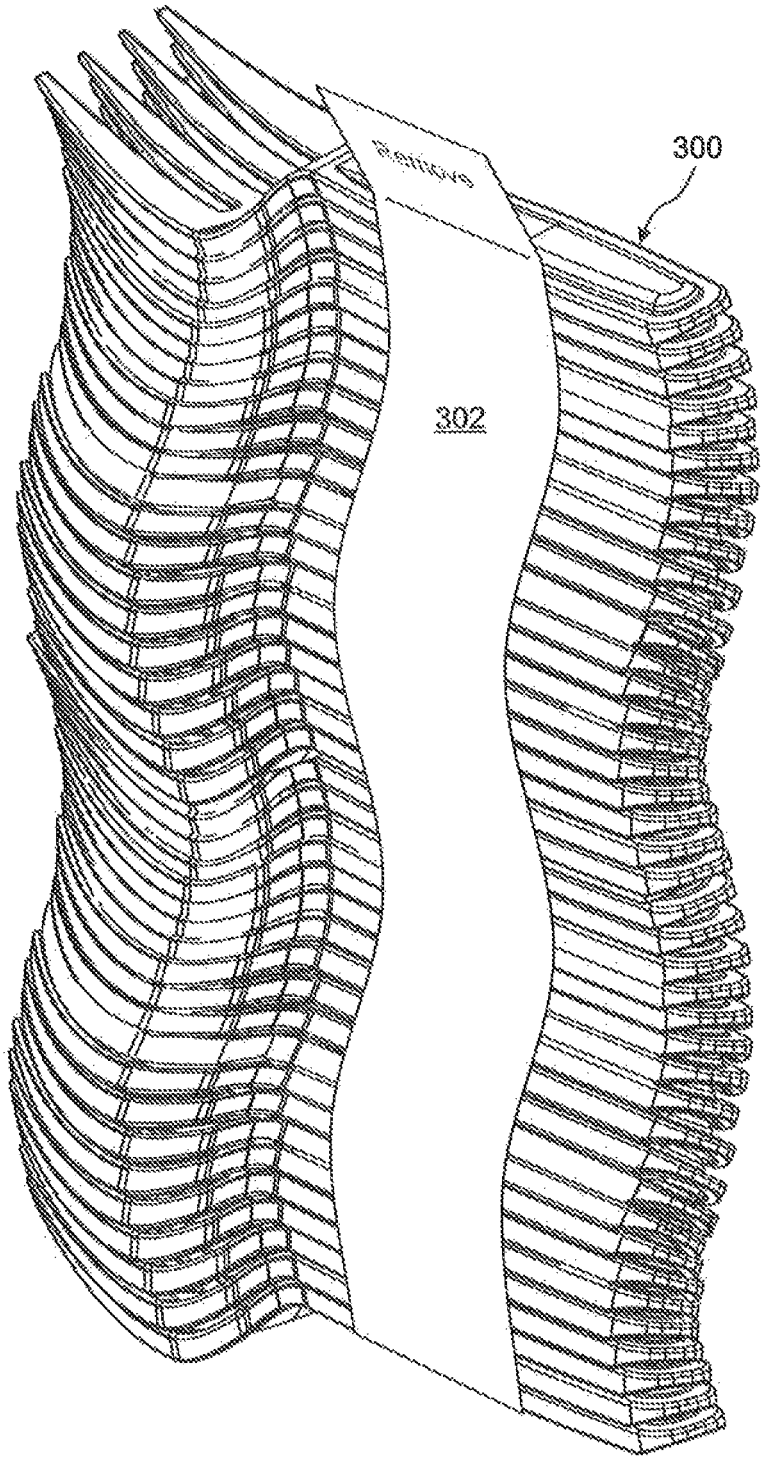
FIG. 4 is a perspective view of the stack of FIG. 3 showing a perturbation of the vertical alignment.

With reference to FIG. 3, according to this general aspect, there is shown a stack 300 of a plurality of inter-nested cutlery articles 100. A single adhesive strip 302 is applied to one side of the cutlery stack 300, which contacts the sides of the nested cutlery items 100 and holds the cutlery items 100 in close vertical association with each other, while the integrity of the stack 300 is maintained during bending and flexing due to the nesting of the stacked cutlery handles 102. This is illustrated in FIG. 4. The inventors have tested the stability of the inter-nested cutlery configuration connected with an adhesive strip, as shown in FIG. 4 by dropping a stack of 40 cutlery pieces from a height of 3-4 feet without separation of the cutlery pieces. As noted above, this configuration offers substantial advantages over prior art as any kind of backer paperboard can be avoided.

Figure 5:
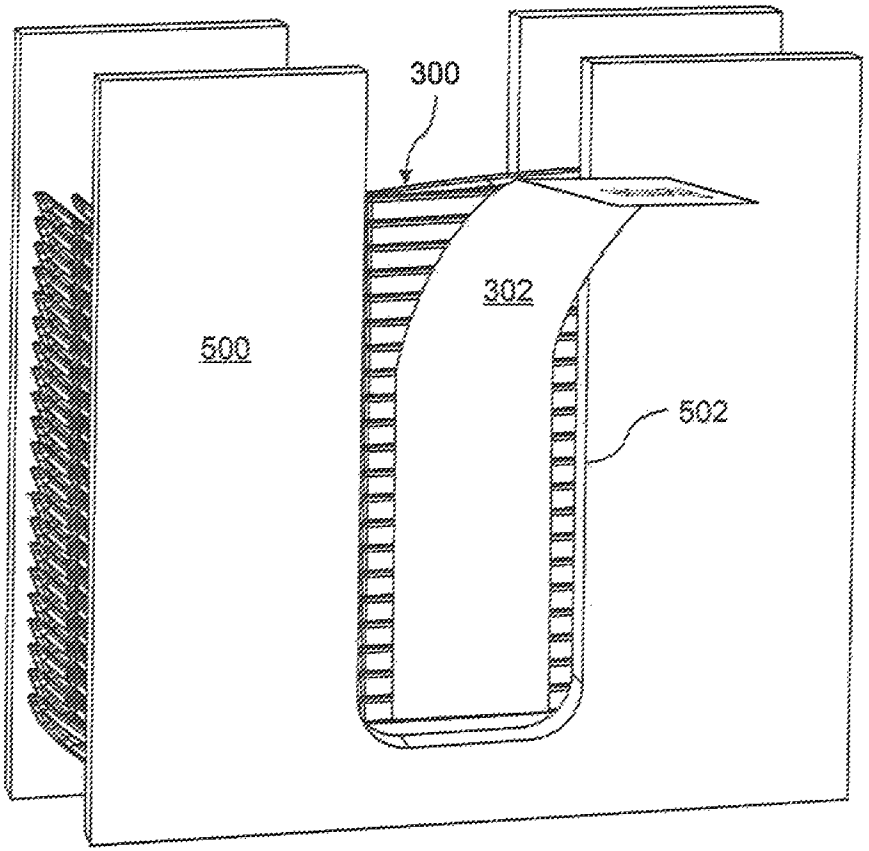
FIG. 5 is a perspective side view of the stack of FIG. 3 arranged inside of a vertically-oriented cutlery dispenser, showing the adhesive strip partially removed through an opening provided in the dispenser.

FIG. 5 is a side perspective view showing the cutlery stack 300 of FIG. 3 inserted into a section 500 of a cutlery dispenser. For ease of understanding and simplicity, the dispenser mechanism for dispensing the cutlery pieces after they are loaded into the dispenser is not shown in these illustrations. In the embodiment of FIG. 5, the dispenser section 500 includes an opening 502 aligned with the side of the stack that provides access to the adhesive strip 302, so that it can be easily removed after the stack 300 is inserted in the dispenser, thereby freeing the individual cutlery items 100 in the stack 300 for dispensing. FIG. 5 is a simplified illustration, which can be taken to represent either the stack 300 fully installed in the dispenser 500, or the stack 300 inserted in an upper section 500 of the dispenser, where the adhesive strip 302 is removed before the stack 300 is allowed to descend to a lower section of the dispenser from which the cutlery will be dispensed. In FIGS. 3-5 fork stacks are shown facing up, however, it will be realized by those skilled in the art that cutlery can be loaded in the dispenser in either orientation, i.e. facing up or facing down depending on the construction of the dispenser and the dispensing mechanism.

Figure 6:
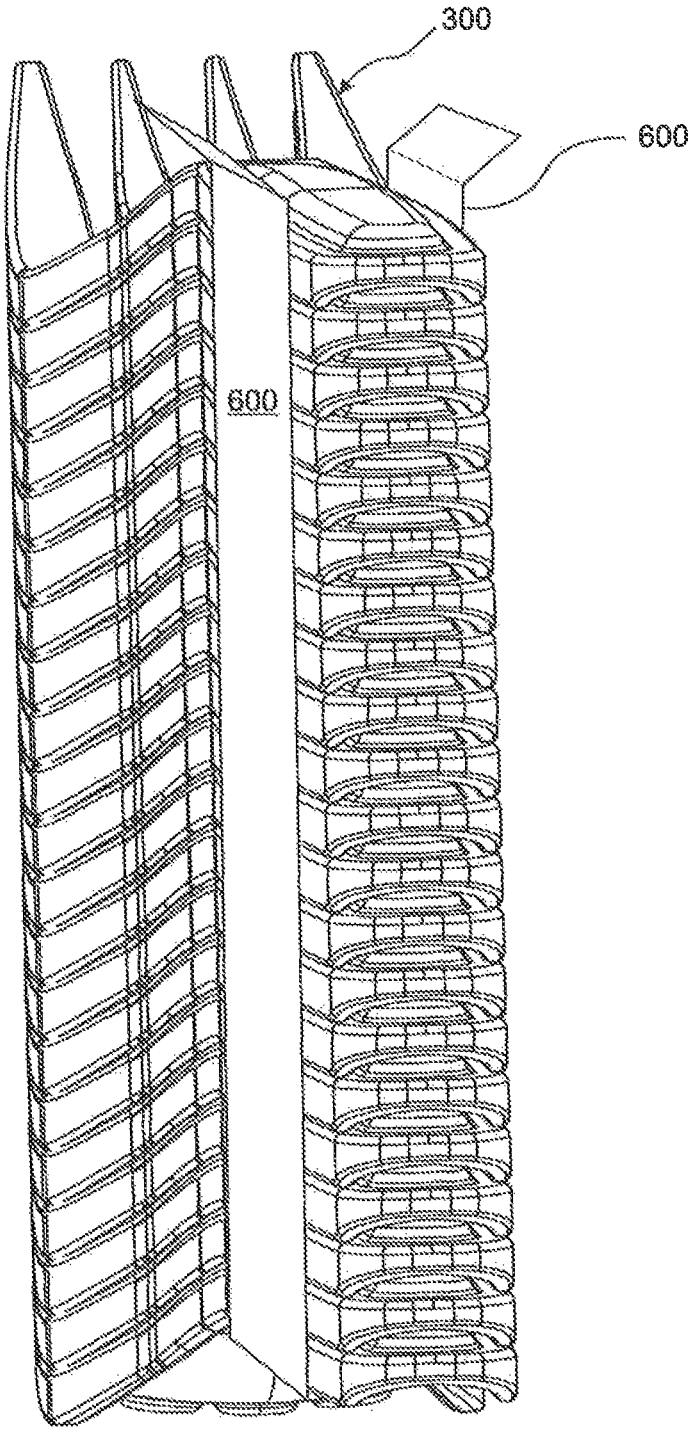
FIG. 6 is a rear perspective view of a stack of cutlery items in a second general aspect of the invention, wherein an adhesive strip is applied to each side of the stack.
Figure 7:
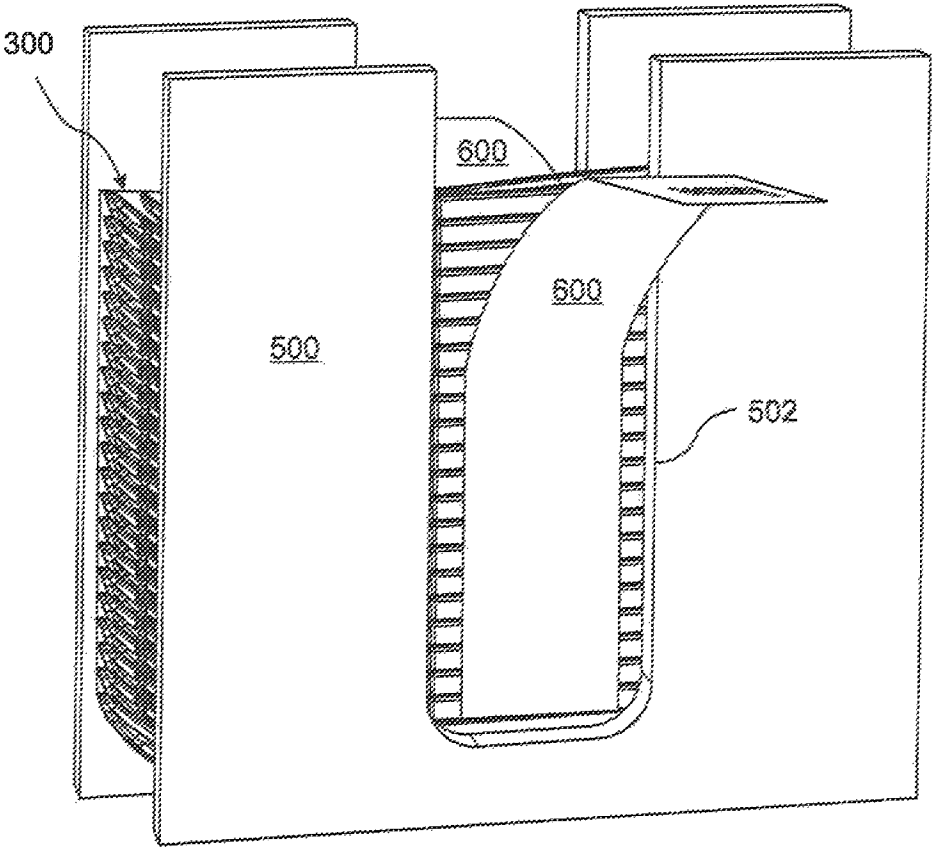
FIG. 7 is a perspective side view of the stack of FIG. 6 arranged inside of a vertically-oriented cutlery dispenser, showing the adhesive strips partially removed through openings provided in the dispenser.

FIG. 6 is a rear perspective view of a second general aspect of the present invention, in which the retaining structure includes two adhesive strips 600, one applied to and contacting each side of the stack. This general aspect places no special requirements on the nesting functionality or shapes of the cutlery handles 102. FIG. 7 is a side perspective view showing the cutlery stack 300 of FIG. 6 inserted into the vertically-oriented cutlery dispenser 500 of FIG. 5. The dispenser 500 includes an opposing pair of openings 502 that provide access to the adhesive strips 600 on both sides of the stack, so that they can be easily removed after the stack 300 is inserted. As in FIG. 5, FIG. 7 is a simplified illustration that can be taken to represent either the stack 300 fully installed in the dispenser 500, or the stack 300 inserted in an upper section 500 of the dispenser, where the adhesive strips 600 are removed before the stack 300 is allowed to descend to a lower section from which the cutlery will be dispensed.

Figure 8:
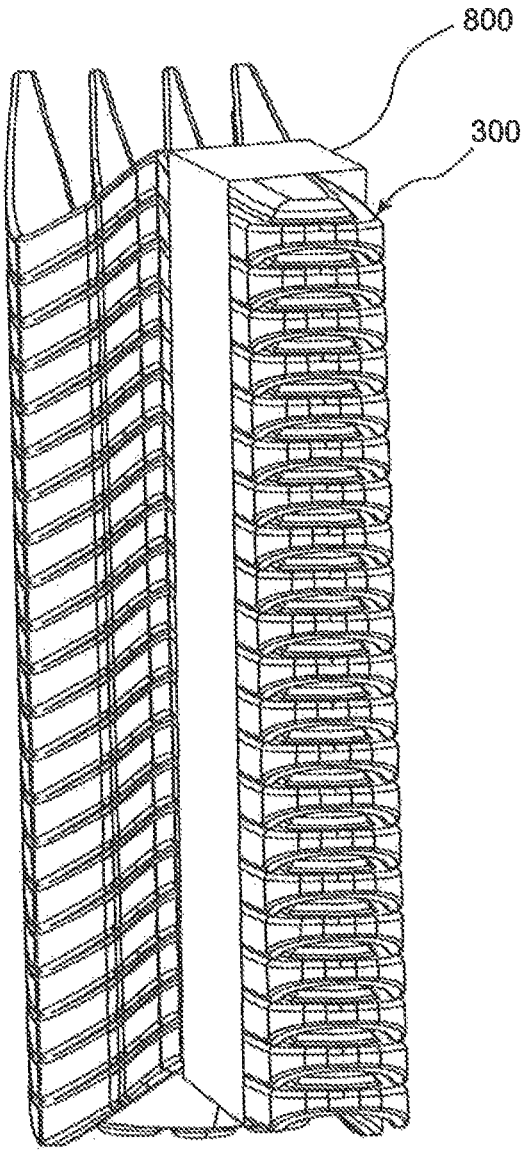
FIG. 8 is a rear perspective view of a stack of cutlery items in a third general aspect of the invention, wherein a band surrounds the handles in the stack.

FIG. 8 is a rear perspective view of a third general aspect of the invention, in which the retaining structure is a band 800 that surrounds the stack 300. Alternate embodiments provide a retaining structure that is a full or partial sleeve surrounding the cutlery stack. In embodiments, the band is made from plastic, paper, paperboard, chipboard, cardboard, bagasse, or any other suitable material. In some embodiments the band extends entirely around the stack, while in other embodiments the band extends around three sides of the stack and is closed on the fourth side by an adhesive strip.

Figure 9B:
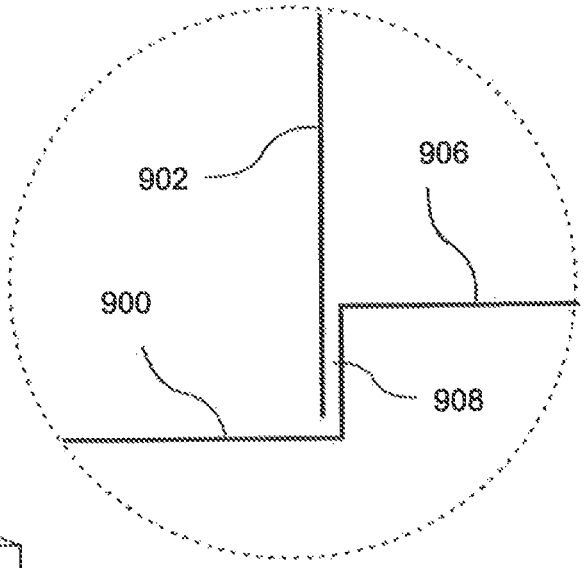
FIG. 9B is a close-up side view of the adhesive attachment of the bottom panel to a side panel of the band of FIG. 9A.
Figure 9A:
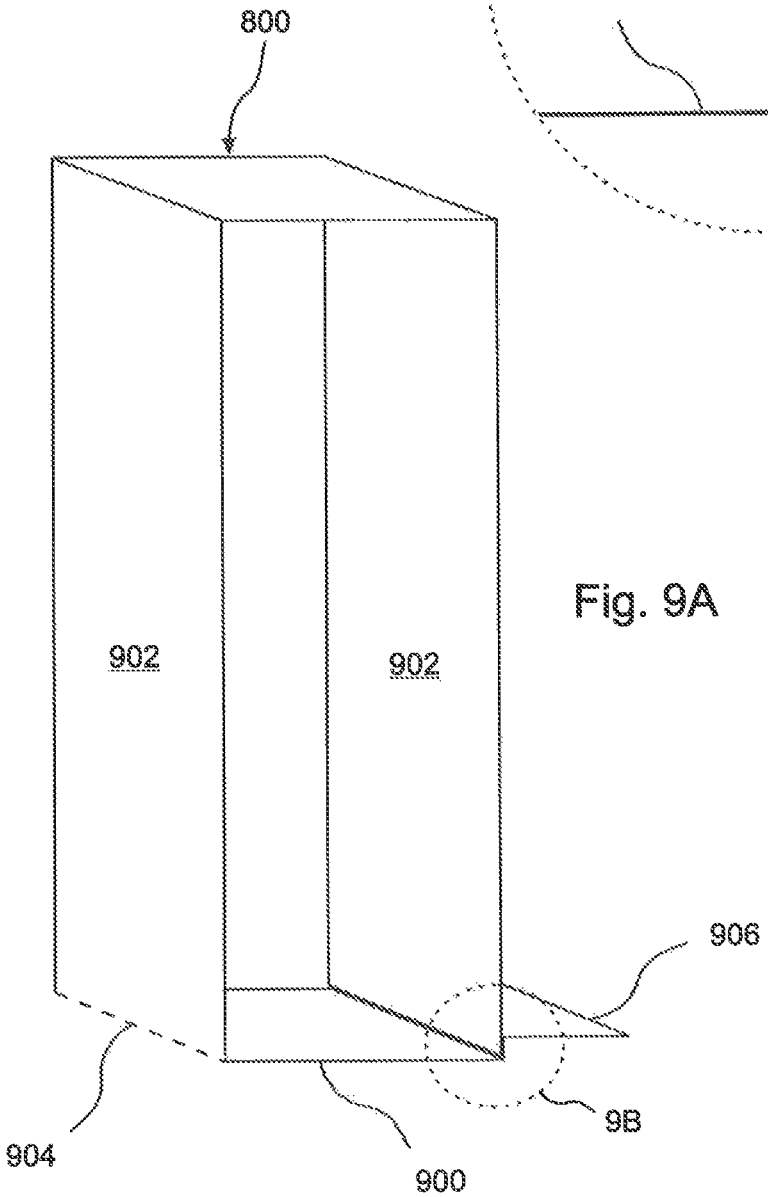
FIG. 9A is a perspective view of the band of FIG. 8, wherein the stack of cutlery items has been removed for clarity of illustration.

With reference to FIGS. 9A and 9B, a band 800 in an embodiment of this general aspect surrounds all four sides of a stack of cutlery, and is configured such that a bottom side thereof 900 is easily opened as the stack 300 is inserted into the dispenser 500 or, if access is available, after the stack 300 has been inserted into the dispenser 500. In the embodiment of FIGS. 9A and 9B, the bottom panel 900 is integral with the sides 902, but includes an adhesive joining 908, a frangible perforation 904, and a pull-tab 906 that allow the bottom 900 to be easily removed, so that the stack of utensils can fall through the bottom of the band and the band can be pulled out from the side or lifted upward and removed.

Figure 9C:
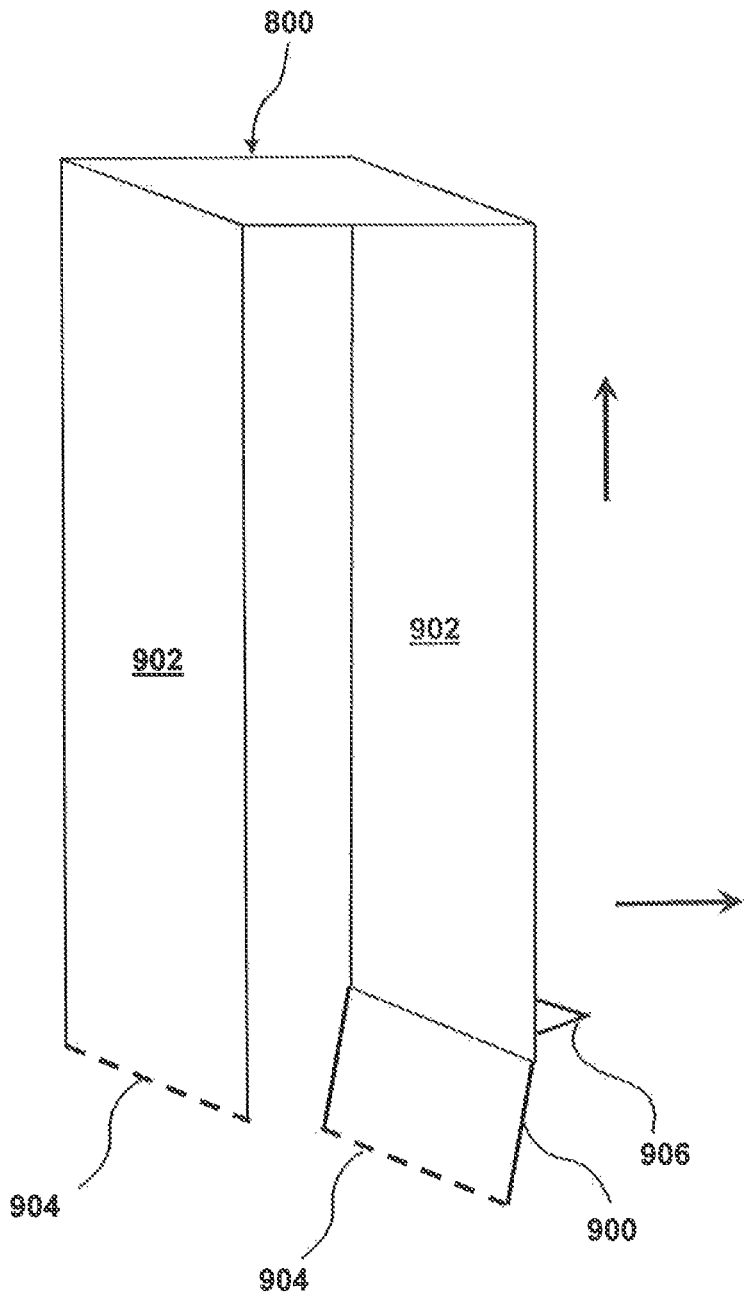
FIG. 9C is a perspective view of the band of FIG. 9A showing a configuration after a pull-tab has been used to break a perforated corner of the band.

FIG. 9C is a perspective view of the band 800 of g. 9A, illustrating removal of the bottom 900, whereby pulling on the pull-tab 906 has broken the frangible perforation 904, so that the bottom 900 of the band 800 is separated from the remainder of the band 900 and can be slid sideways out from under the stack of cutlery 300 (not shown in the figure) and the entire band can be removed from the dispenser.

Figure 10:
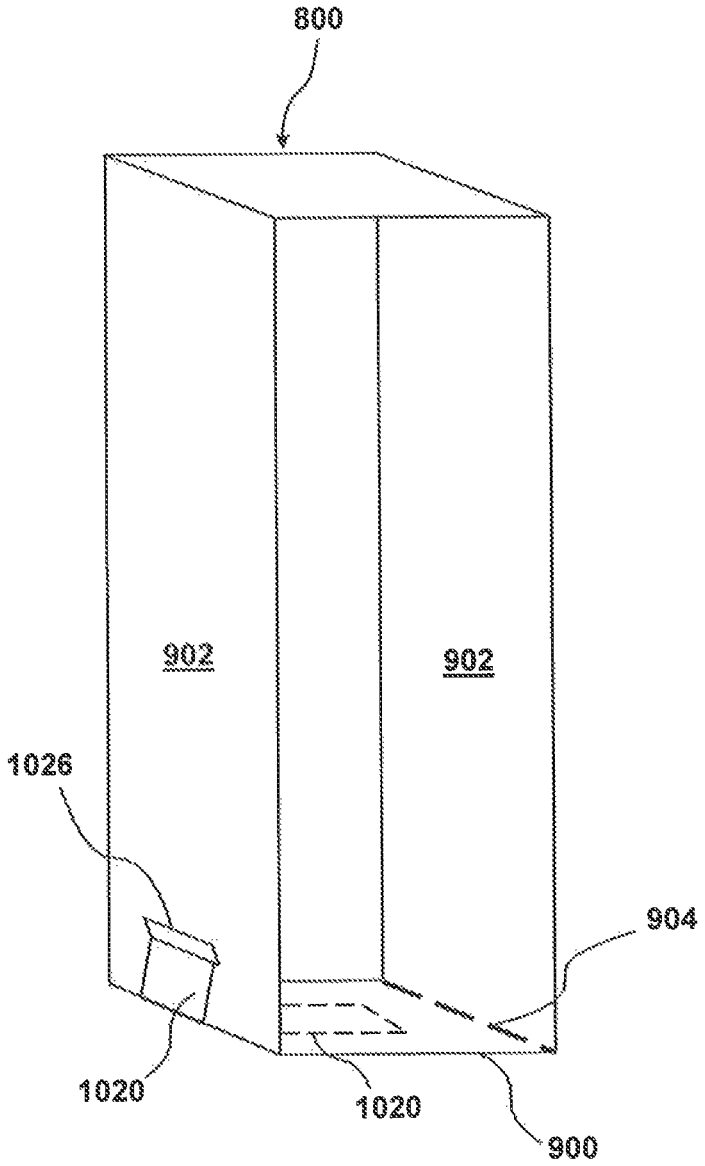
FIG. 10 is a perspective view of an embodiment similar to FIG. 9A, except that the bottom "panel" is secured with an adhesive strip.

FIG. 10 illustrates an embodiment of this general aspect that is similar to FIG. 9A, except that the cutlery holding band 800 is initially in the form of strap. The bottom side of the band 800 is closed by an adhesive strip 1020 having an adhesive layer facing towards the side 902 and bottom 900 of band 800. The adhesive strip 1020 terminates into a pull tab 1026. In some embodiments the bottom 900 includes a frangible perforation 904, so that bottom portion can be severed from the band 800 by pulling on pull tab 1026 and removing the remainder of band 800 from the dispenser.

In FIG. 10, the closed side of band 800 is shown on the top with the adhesive strip 1020 installed at the bottom end, which is initially open for stacking cutlery within the U-shaped structure 800. In other embodiments, the band 800 is oriented so that the closed end is at the bottom and the adhesive strip 1020 is installed on the top. In the embodiment of FIG. 10 the adhesive layer is not in contact with any of the cutlery pieces.

The foregoing description of the embodiments of the invention has been presented for the purposes of illustration and description. Each and every page of this submission, and all contents thereon, however characterized, identified, or fly numbered, is considered a substantive part of this application for all purposes, irrespective of form or placement within the application.

This specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, to the fullest extent dependent claims are logically combinable with each other.

What is claimed is:

1. An assembly of cutlery items, the assembly comprising:

a vertically aligned, nested stack of identical cutlery items, each of the identical cutlery items within said stack comprising a head and a handle, said identical cutlery items thus comprising respective identical heads and respective identical handles arranged in a mutually aligned relationship and in direct mutual contact with each other; and a retaining structure that is able, in combination with said nesting of said cutlery items, to maintain said nested stack in said vertically aligned, nested relationship without assistance from any additional structures, said retaining structure being applied to only one side of the stack and being readily removable from said stack of said identical cutlery items by pulling on a free end of said retaining structure, said retaining structure being an adhesive strip.

2. The assembly of cutlery items of claim 1, wherein said handle of each identical of said cutlery items in said stack includes an inter-nesting feature, said inter-nesting feature being characterized by preventing movement of the identical cutlery items in said stack relative to each other by more than 0.2 inches in a direction transverse to a longitudinal axis of the respective identical handles in said stack.

3. The assembly of cutlery items of claim 1, wherein each of said identical cutlery items includes an inter-nesting feature that prevents movement of the respective identical handles relative to each other of more than 0.1 inches in a direction transverse to a longitudinal axis of the respective identical handles in said stack.

4. The assembly of cutlery items of claim 1, wherein at least a portion of said handle of each of said identical cutlery items has a protrusion on a first surface thereof and a corresponding hollow on an opposing second surface thereof, and wherein the protrusion on the handle of each of said identical cutlery items nests within the hollow of another of the identical cutlery items located adjacent to it in said stack.

5. The assembly of cutlery items of claim 4, wherein the protrusion on a first surface of each handle nests within the hollow of the adjacent handle in the stack to a depth that is at least 20% of a vertical thickness of the handle.

6. The assembly of cutlery items of claim 1, wherein said adhesive strip being at least 0.75 inches wide.

7. The assembly cutlery items of claim 1, wherein said stack of identical cutlery items is one of:

a stack of forks;

a stack of spoons;

a stack of knives; and a stack of sporks.

8. The assembly of cutlery items of claim 1, wherein each of said identical cutlery items is constructed from a plastic material.

* * * * *